US007310835B2

(12) United States Patent
Walker

(10) Patent No.: US 7,310,835 B2
(45) Date of Patent: Dec. 25, 2007

(54) FLEXING SUPPORT IN A SPA

(75) Inventor: Victor Lee Walker, Murrietta, CA (US)

(73) Assignee: Dimension One Spas, Vista, CA (US)

( * ) Notice: Subject to any disclaimer, the term of this patent is extended or adjusted under 35 U.S.C. 154(b) by 151 days.

(21) Appl. No.: 10/871,331

(22) Filed: Jun. 18, 2004

(65) Prior Publication Data

US 2005/0278845 A1 Dec. 22, 2005

(51) Int. Cl.
*A47K 3/00* (2006.01)

(52) U.S. Cl. ..... 4/541.1; 4/575.1

(58) Field of Classification Search ..... 4/541.1, 4/575.1; 5/636
See application file for complete search history.

(56) References Cited

U.S. PATENT DOCUMENTS

D364,303 S 11/1995 Larsen
5,682,625 A 11/1997 Leaverton et al.
5,716,333 A 2/1998 Larsen
5,928,171 A 7/1999 Larsen
6,551,263 B2 4/2003 Turner
2004/0139548 A1* 7/2004 Hwang-Pao ..... 5/636

OTHER PUBLICATIONS

Hot Springs, Watkins, Spa Information.

* cited by examiner

*Primary Examiner*—Charles E. Phillips
(74) *Attorney, Agent, or Firm*—Fish & Richardson P.C.

(57) ABSTRACT

Systems and techniques to provide a flexing support in a spa, such as a flexing spa headrest. In general, in one implementation, a system includes a surface defining a multi-level recess including a primary recess and secondary mounting recesses, and a pillow including a flexible concave pad and mounts that couple the flexible concave pad with the surface, the secondary mounting recesses receiving the mounts such that the flexible concave pad is suspended above the primary recess, a curved edge of the flexible concave pad contacts the surface, and the flexible concave pad mechanically flexes concavely between the mounts and about the curved edge when force is applied.

17 Claims, 21 Drawing Sheets

(G-G)

(H-H)

(L-L)

(K-K)

(H-H)

(C-C)

(B-B)

(A-A)

FLEXING SUPPORT IN A SPA

BACKGROUND

The present application describes systems and techniques relating to spas, for example, a spa headrest.

Conventional spa headrests are often cushions or pillows that are static in design. When a soft material is used to construct the headrests in a spa, these headrests typically harden or degrade over time as the original soft material is exposed to harsh weather and the water environment inside the spa, providing lower comfort levels as the product wears in the course of its normal life cycle. Some spa pillows have also added a mechanical deflection cushioning component, as opposed to just compression cushioning, by removing some of the material of the pillow fixed to the spa wall, so that the front surface of the pillow is suspended away from the spa wall. Additionally, various fully suspended spa headrests have been used that provide dynamic flexion between dual post fasteners to provide suspension cushioning, where the spa headrest only contacts the spa wall through the dual post fasteners.

SUMMARY

The present disclosure includes systems and techniques relating to a flexing support in a spa, such as a flexing spa headrest. According to an aspect, a system includes a surface defining a multi-level recess including a primary recess and secondary mounting recesses, and a pillow including a flexible concave pad and mounts that couple the flexible concave pad with the surface, the secondary mounting recesses receiving the mounts such that the flexible concave pad is suspended above the primary recess, a curved edge of the flexible concave pad contacts the surface, and the flexible concave pad mechanically flexes concavely between the mounts and about the curved edge when force is applied.

One or more of the following advantages may be provided. A flexing spa headrest can enable a large variety of users to have a spa cushion that adjusts to their different head pressures and head sizes, and that promotes correct posture and head positioning. The flexing headrest can function the same when in water or when dry, enabling a potential buyer to see and feel the benefits of the improved headrest before a purchase is made. The flexing headrest can be suspended from two fixed points and flex with respect with those points to provide mechanical motion that actually cradles the head. This can create a very soft and interactive headrest that relieves under pressure, as a pillow does, adjusting to the different needs of spa users. The mechanical flexing movement can automatically give the headrest a very soft feel, irrespective of the material used to construct the headrest, and can create a higher level of comfort during use, while also providing high durability and a long life span. Moreover, the headrest design and materials can result in easy assembly.

Details of one or more embodiments are set forth in the accompanying drawings and the description below. Other features and advantages may be apparent from the description and drawings, and from the claims.

BRIEF DESCRIPTION OF THE DRAWINGS

Like reference symbols in the various drawings indicate like elements.

DETAILED DESCRIPTION

Figure 1:
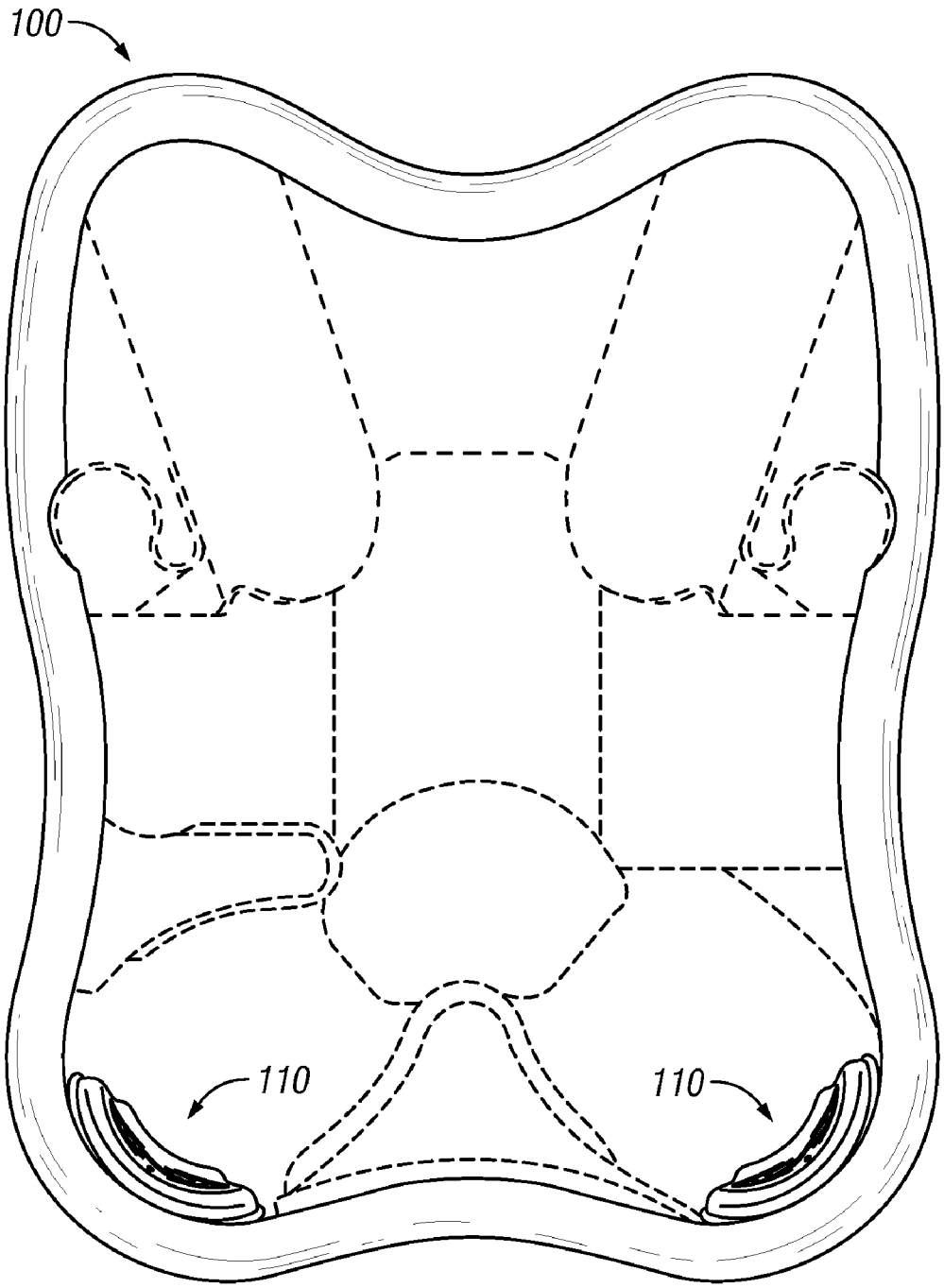
FIG. 1 is a top view of an example spa with two flexing spa headrests.

The systems and techniques described here relate to spa headrests. As used herein, the term "spa" means a tub used for relaxation, invigoration or health, and can include a device for moving water in the tub; the term "spa" includes hot tubs, bathtubs, whirlpool baths, in-ground spas, free-standing spas, swim spas, and spas and pools generally, regardless of size. FIG. 1 is a top view of an example spa 100 with two flexing spa headrests 110. The headrests 110 can be part of the spa seats in the spa 100, providing cushions for users to rest their heads against during spa use (e.g., hydrotherapy). Although referred to as a headrest, the described and claimed system can also be used to support other body parts (e.g., as a support in a seat or a back cushion). The spa 100 can have any shape and any number of seats in any manner of arrangements. The headrest can be used with all spa seats, regardless of position, including a spa seat in a lounge position.

When in use, the headrests 110 can flex in response to applied pressure. The headrests 110 can move in a flexure manner, providing spa users with a comfortable head cushion that adjusts to each particular user. The headrest can physically move in a flexure way when the user rests their head against the headrest; the headrest can act as a pillow, in that the headrest can give way to the weight of a person's head. Thus, the headrest can cradle the person's head and give a very soft feeling of comfort to the user, even when the headrest material itself is not soft. The headrests 110 can flex into a cavity defined by a surface included in the spa 100. This recess is positioned and angled to promote good spine alignment in a seat. This spine alignment promotes good head position and allows the user to further enjoy the benefits of hydrotherapy. This pillow/recess angle changes, depending on the seat design. The recess is a multi-level recess described further below.

The surface defining the multi-level recess can be integral to the spa 100. For example, the spa 100 can be a free-standing spa, and the surface can be a part of the spa shell. Alternatively, the surface defining the multi-level recess can be part of a separate apparatus that connects to the spa wall. For example, the spa 100 can include a housing that includes the surface. The housing can couple with the spa wall, can be adjustable, and can be removed when needed. An example of such a housing is described in U.S. Pat. No. 5,682,625, issued Nov. 4, 1997 and entitled "HOT TUB WITH ADJUSTABLE HEADREST WITH WATER JET", which is hereby incorporated by reference.

Figure 2:
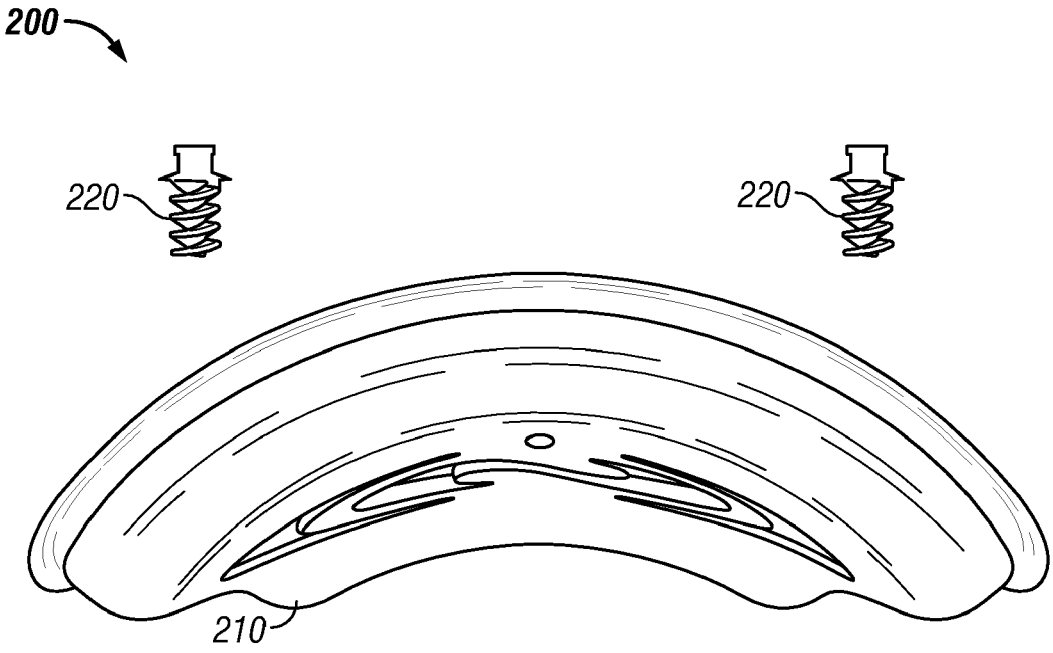
FIG. 2 is an exploded top view of an example headrest.
Figure 3:
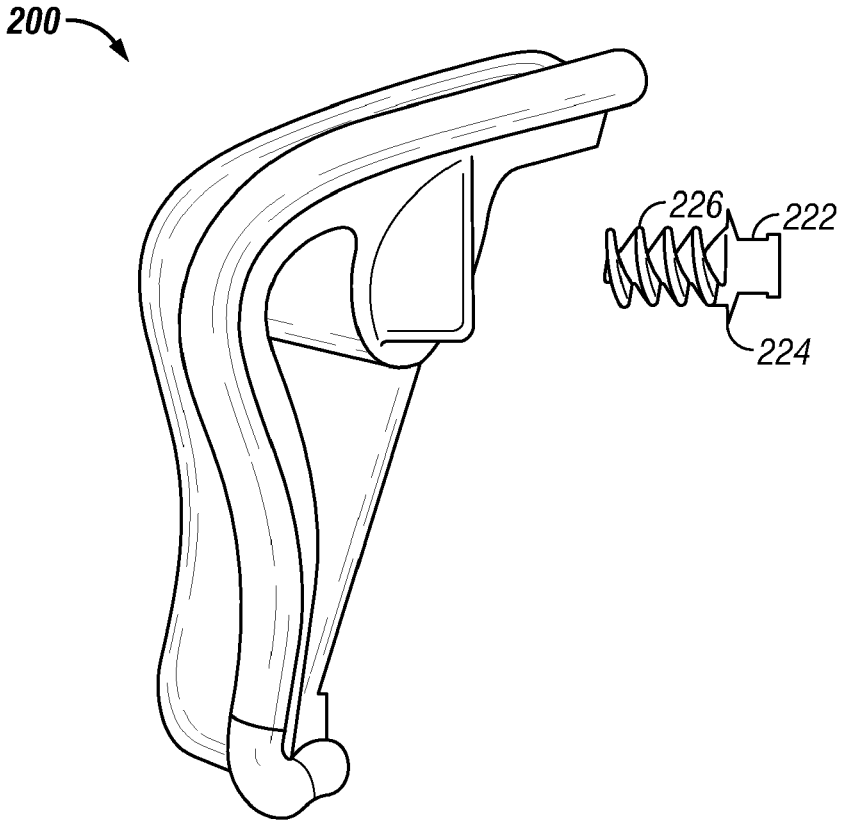
FIG. 3 is an exploded side view of the headrest from FIG. 2.
Figure 4:
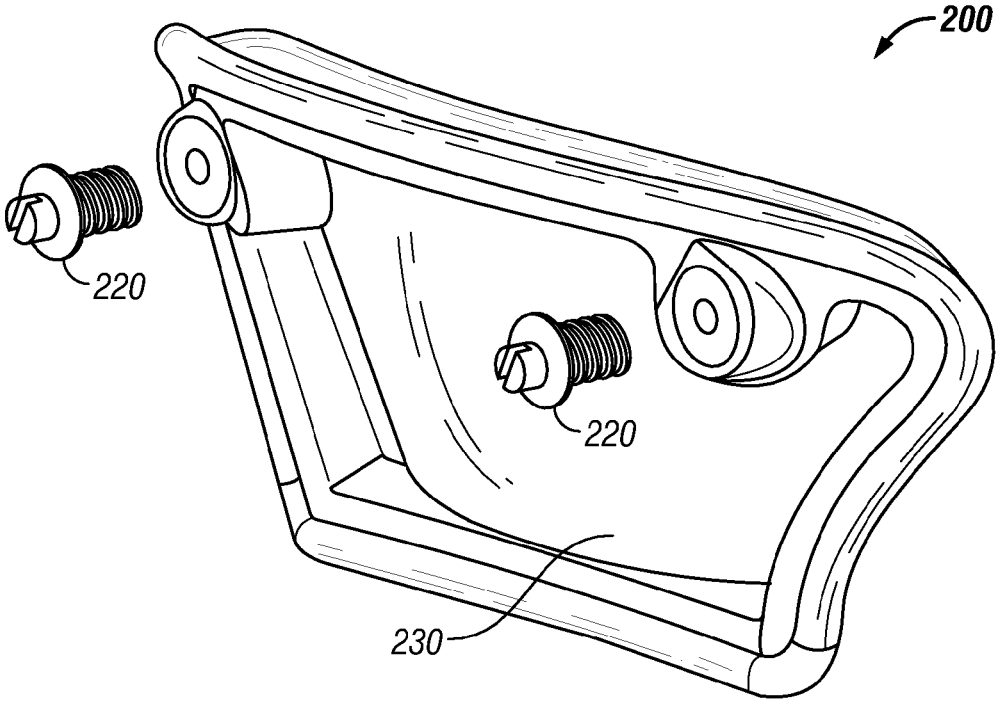
FIG. 4 is an exploded back perspective view of the headrest from FIG. 2.

FIG. 2 is an exploded top view of an example headrest 200. FIG. 3 is an exploded side view of the headrest 200. FIG. 4 is an exploded back perspective view of the headrest 200. The headrest 200 can include a pad 210 and mounts 220 that couple with the pad. More than two mounts 220 can be used in alternative implementations. The mounts 220 provide connection points with which to attach the headrest 200 to a spa.

The mounts 220 can allow the headrest to flex when in use. The pad 210 can include a curved flexible cushion 230 that flexes concavely between the mounts 220. The cushion 230 can be made of a soft pliable material with a thin cross section (e.g., Urethane and/or Silicone, or EVA (Ethylene Vinyl Acetate), with an approximate thickness of 0.25 to 0.7 inches). An applied weight causes the cushion 230 to flex into the cavity behind it and around the head. At least part of the cushion effect of the cushion 230 can come from the mechanical motion of the pad 210 under weight, and thus the cushion 230 need not be made of an extremely soft material, due to the multi-level recess's ability to allow a material (even stiffer ones) to move past the adjacent surfaces of the shell causing a flexure motion. The flexure movement allows the cushion 230 to adjust to the different pressures of a large variety of users, and the flexure movement generally does not deteriorate over time. Thus, the headrest 200 can provide a higher quality, longer lasting product than traditional spa headrests.

The mounts 220 can couple with the pad 210 in a cantilevered fashion. The mounts 220 can be flexible pins that have a flange 224, a proximate end 226 having a surface defining holding feature, such as a thread (e.g., a screw shape), and a distal end 222 having a surface defining a slot or slots. The distal end of the pin can be a bendable boss that can be inserted into a receiving secondary recess of a spa surface (e.g., a spa wall, a spa headrest housing or a cup). The pins work in tandem with the mounting boss on the pillow to interact with the multi-level recess in such a way to promote mechanical movement. The pin is mounted into the secondary recess, as described further below.

Figure 5:
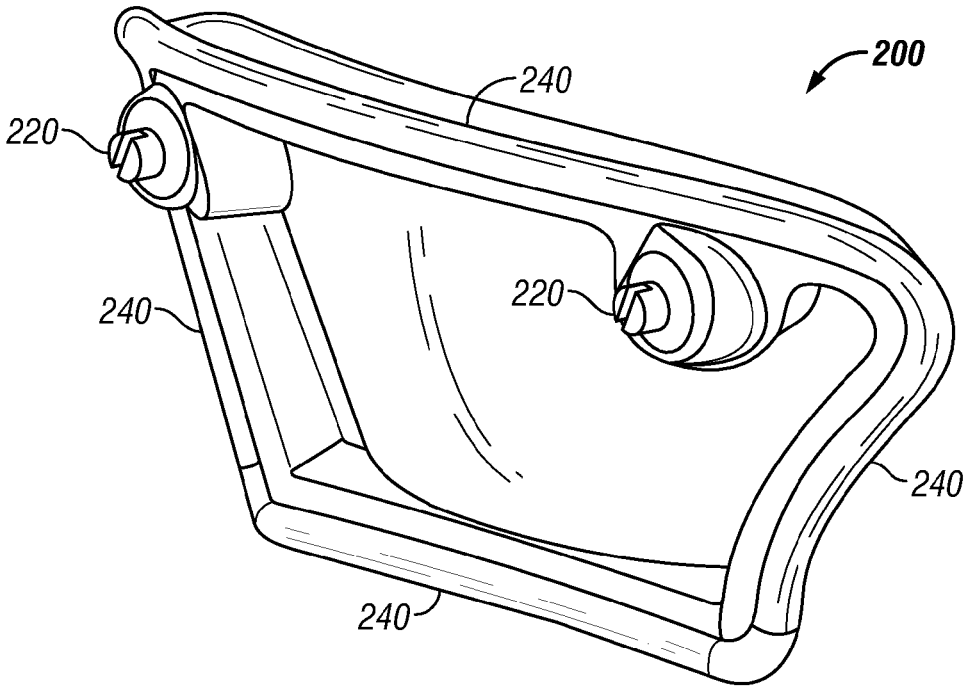
FIG. 5 is a back perspective view of the headrest from FIG. 2 with the mounts attached.
Figure 6:
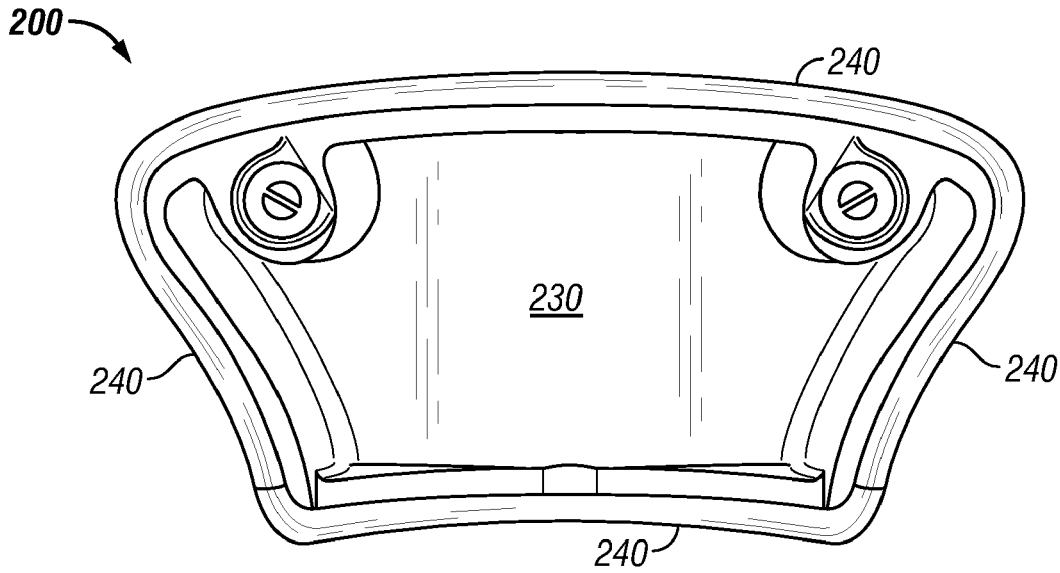
FIG. 6 is a back view of the headrest from FIG. 2 with the mounts attached.
Figure 7:
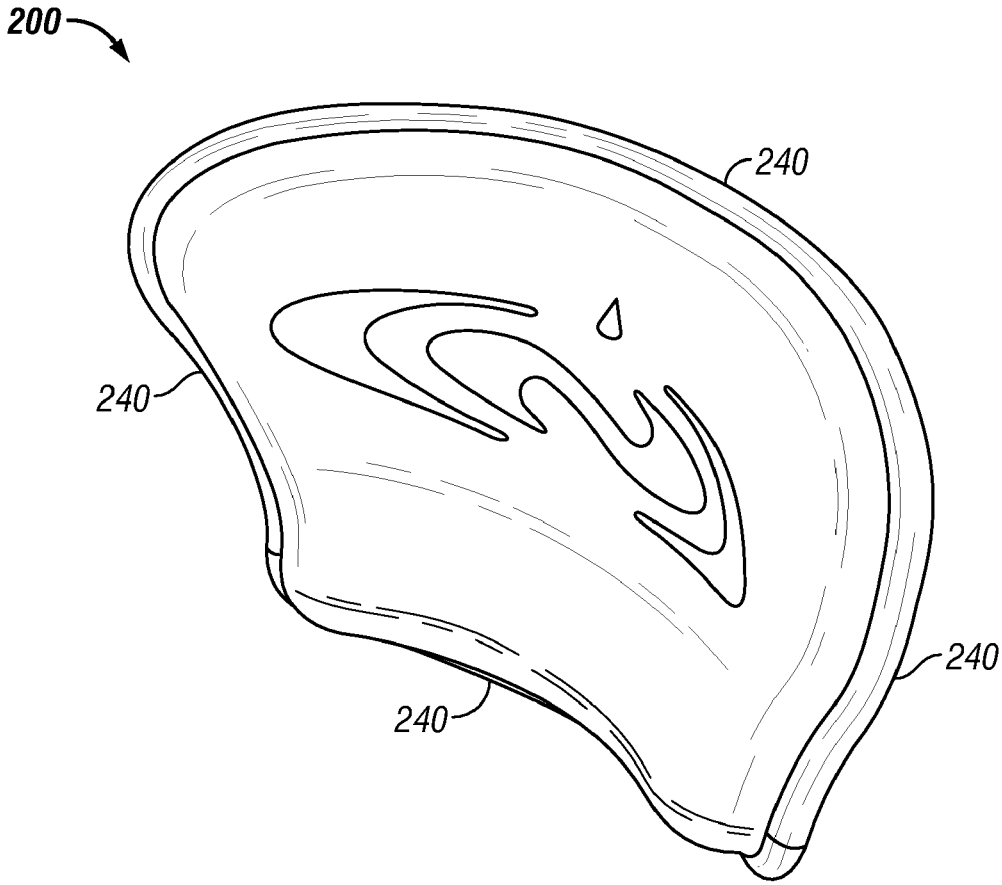
FIG. 7 is a front perspective view of the headrest from FIG. 2 with the mounts attached.

FIG. 5 is a back perspective view of the headrest 200 with the mounts attached. FIG. 6 is a back view of the headrest 200 with the mounts attached. FIG. 7 is a front perspective view of the headrest 200 with the mounts attached. The locations of the mounting pins and the shape of the headrest, as shown, can facilitate mechanical flexing. The pins can be flush mounted. The edges 240 of the pad can be contoured as shown to facilitate the mechanical movement of the headrest 200, allowing the headrest 200 to easily flex inward and then return to the original neutral position; the mechanical operation of the headrest 200 can be similar to that of a hammock, which flexes when weight is applied to the hammock, which is attached at two fixed points. In addition, the surface defining the cavity behind the headrest 200 can be shaped to accept the full range of flexion, dependent upon the range of forces designed for, without the cushion 230 contacting the surface behind it.

Figure 8:
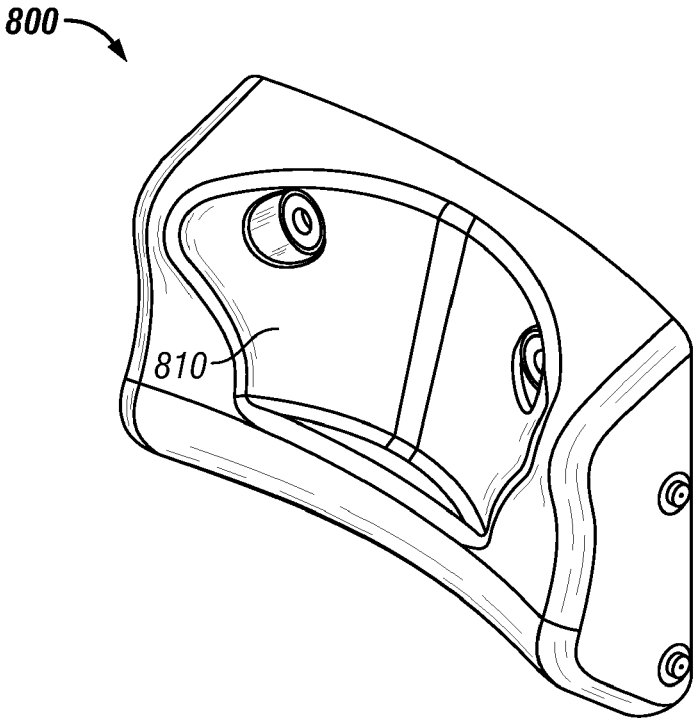
FIG. 8 is a front perspective view of an example headrest housing.
Figure 9:
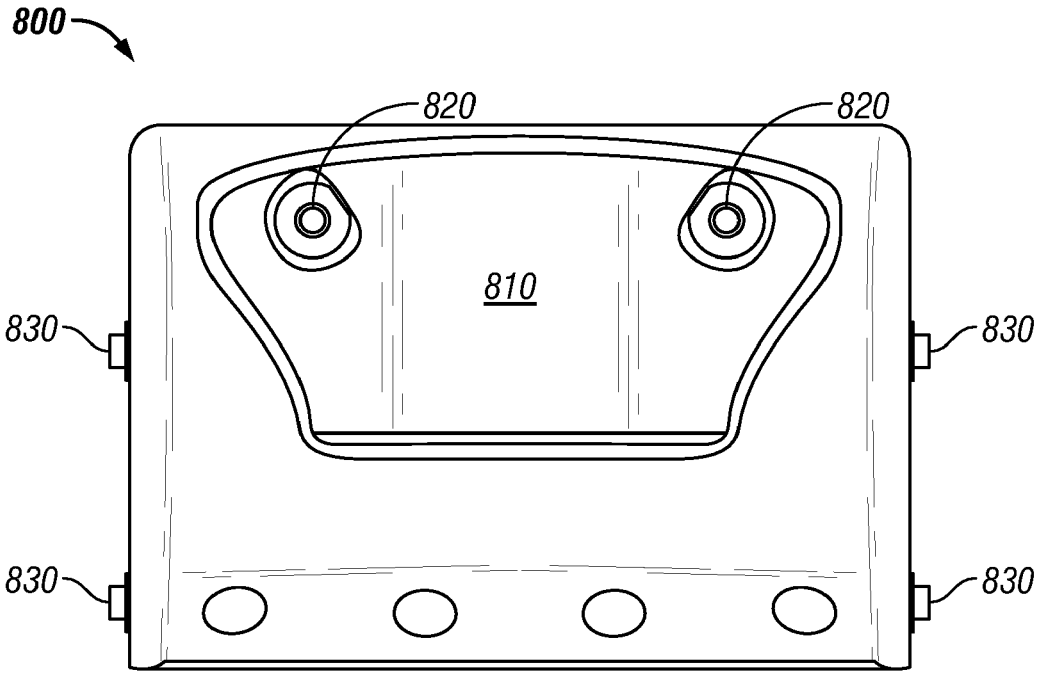
FIG. 9 is a front view of the headrest housing from FIG. 8.
Figure 10:
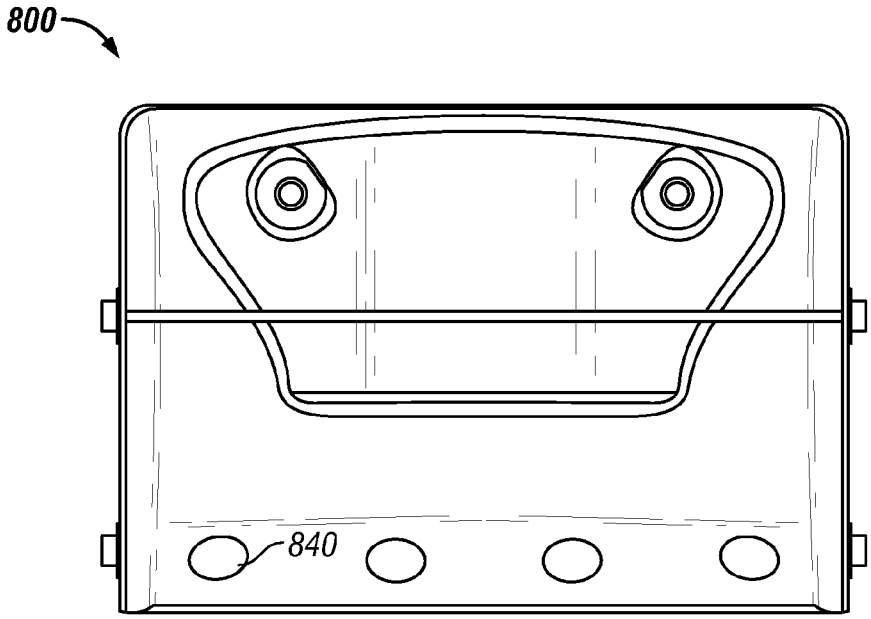
FIG. 10 is back view of the headrest housing from FIG. 8.

FIG. 8 is a front perspective view of an example headrest housing 800. FIG. 9 is a front view of the headrest housing 800. FIG. 10 is back view of the headrest housing 800. The housing 800 includes a surface that defines a cavity 810 shaped to receive a flexing headrest. This cavity 810 can be a multi-level recess that is compatible with the headrest described above, complimenting the flexing motion of the cushion. The surface can include secondary recesses 820 to receive mounts on the headrest. The secondary recesses 820 can ensure that the mounts of the headrest are on a plane in the multi-level recess that allows the flexing of the cushion to take place.

The surface can be made part of an apparatus that attaches to a spa, as shown, or the surface can be made part of a spa wall directly. Additionally, the housing 800 can include mounts 830 used to attach the housing 800 to a spa. The housing 800 can also include holes, such as a hole 840, through which jets can expel water for hydrotherapy in the spa. Alternative housing configurations are also possible.

Figure 11:
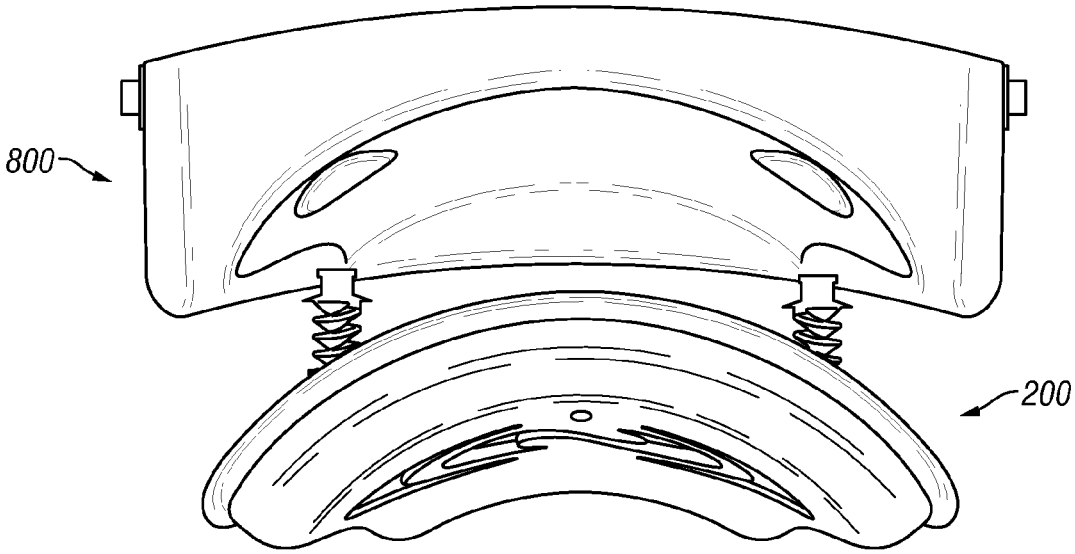
FIG. 11 is an exploded top view of the housing and headrest from FIGS. 2 & 8.
Figure 12:
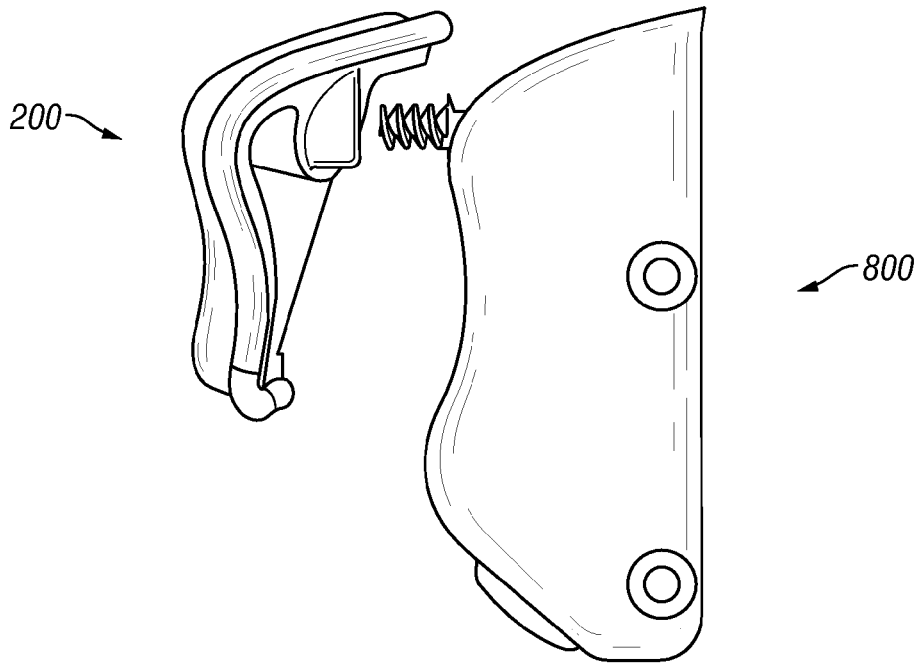
FIG. 12 is an exploded side view of the housing and headrest from FIGS. 2 & 8.
Figure 13:
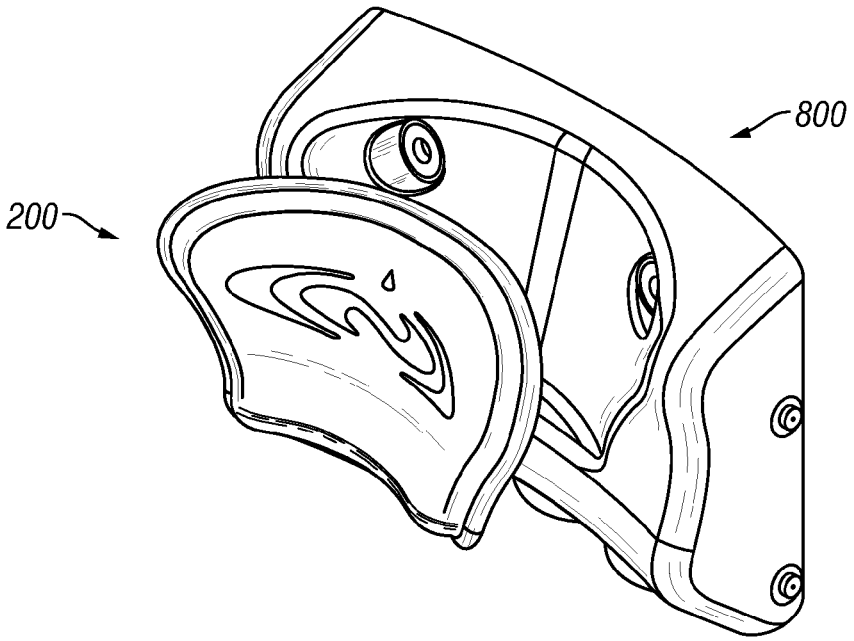
FIG. 13 is an exploded perspective view of the housing and headrest from FIGS. 2 & 8.
Figure 14:
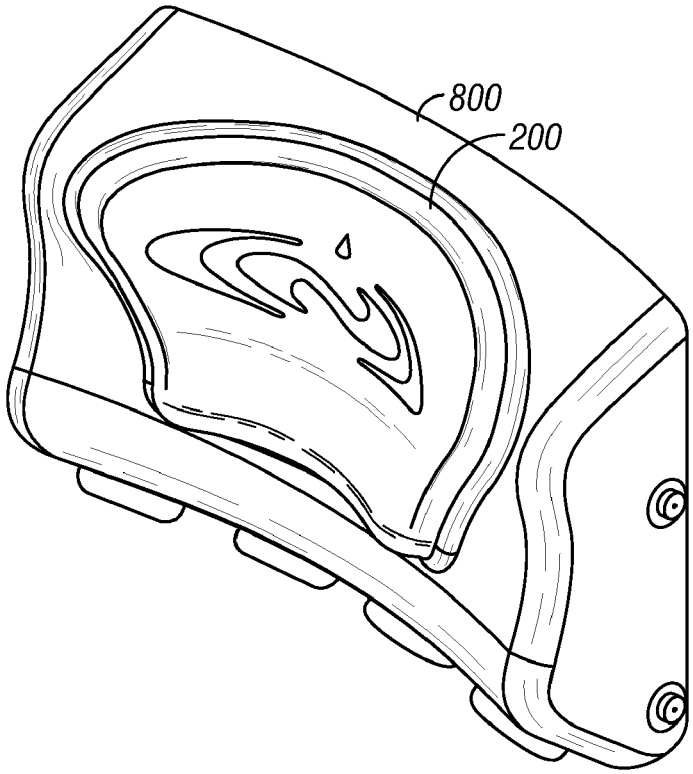
FIG. 14 is a perspective view of the housing with the headrest in place.
Figure 15:
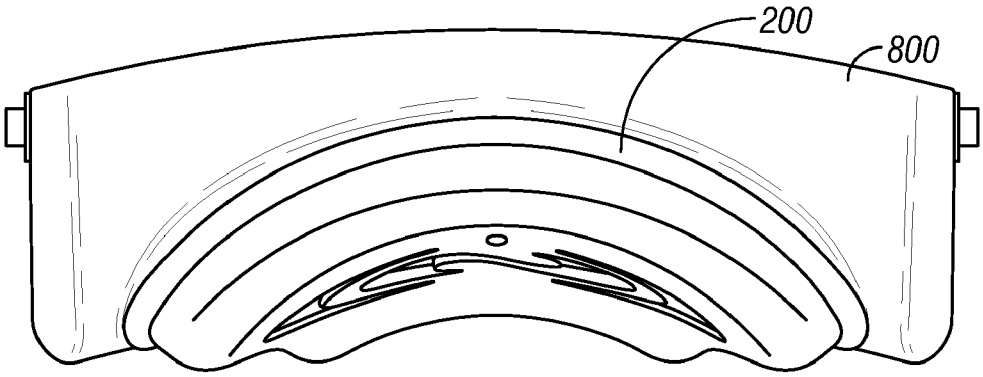
FIG. 15 is a top view of the housing with the headrest in place.
Figure 16:
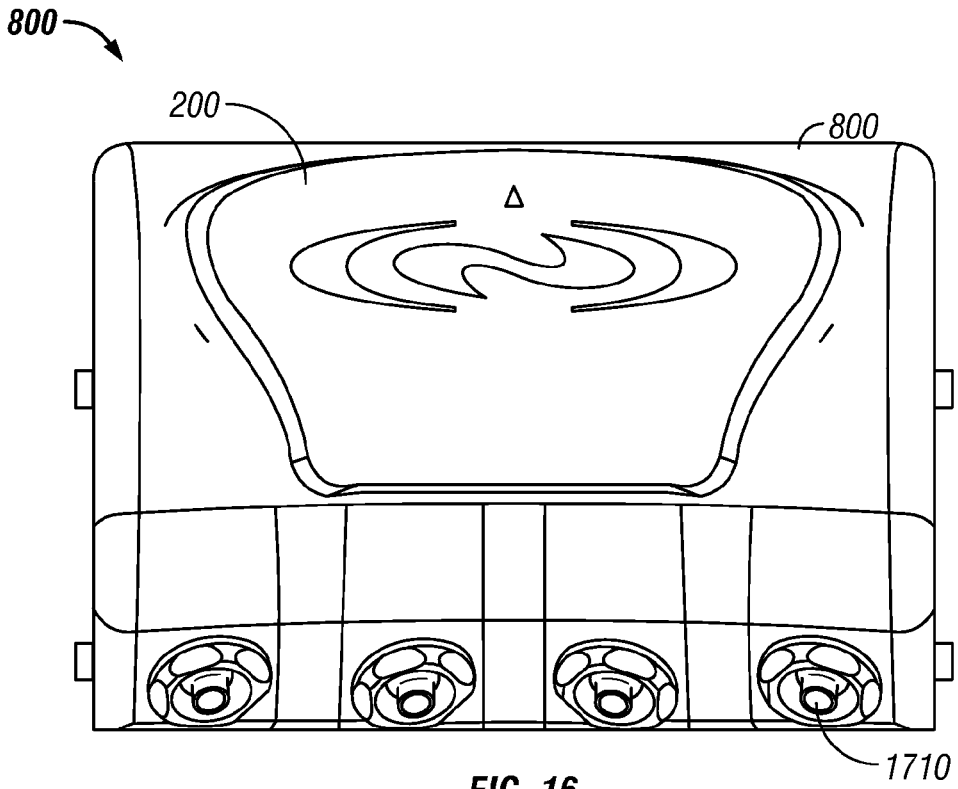
FIG. 16 is a front view of the housing with the headrest in place and jets included in the housing.
Figure 17:
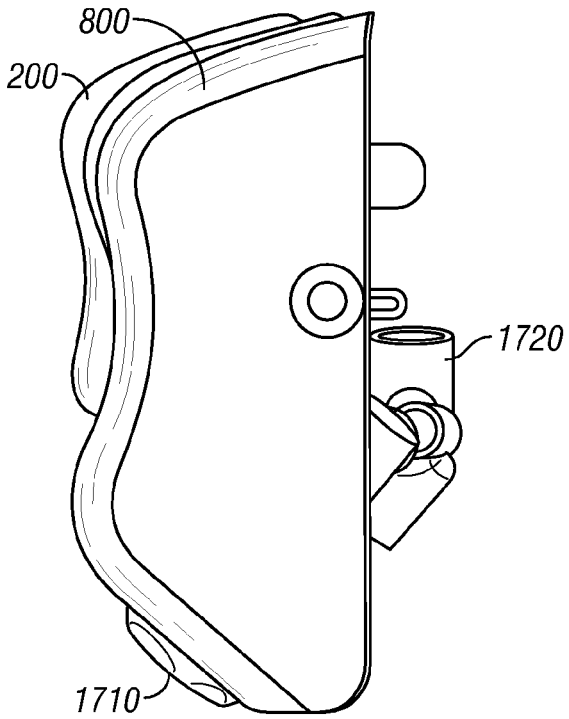
FIG. 17 is a side view of the housing and headrest from FIG. 16.

FIG. 11 is an exploded top view of the housing 800 and the headrest 200. FIG. 12 is an exploded side view of the housing 800 and the headrest 200. FIG. 13 is an exploded perspective view of the housing 800 and the headrest 200. FIG. 14 is a perspective view of the housing 800 with the headrest 200 in place. FIG. 15 is a top view of the housing 800 with the headrest 200 in place. FIG. 16 is a front view of the housing 800 with the headrest 200 in place and jets included in the housing. FIG. 17 is a side view of the housing 800 and headrest 200 from FIG. 16. One or more jets 1710 can be included in the housing 800, as shown. Water can be provided to the jet(s) 1710 through pipe(s) 1720 also included in the housing 800.

Figure 18:
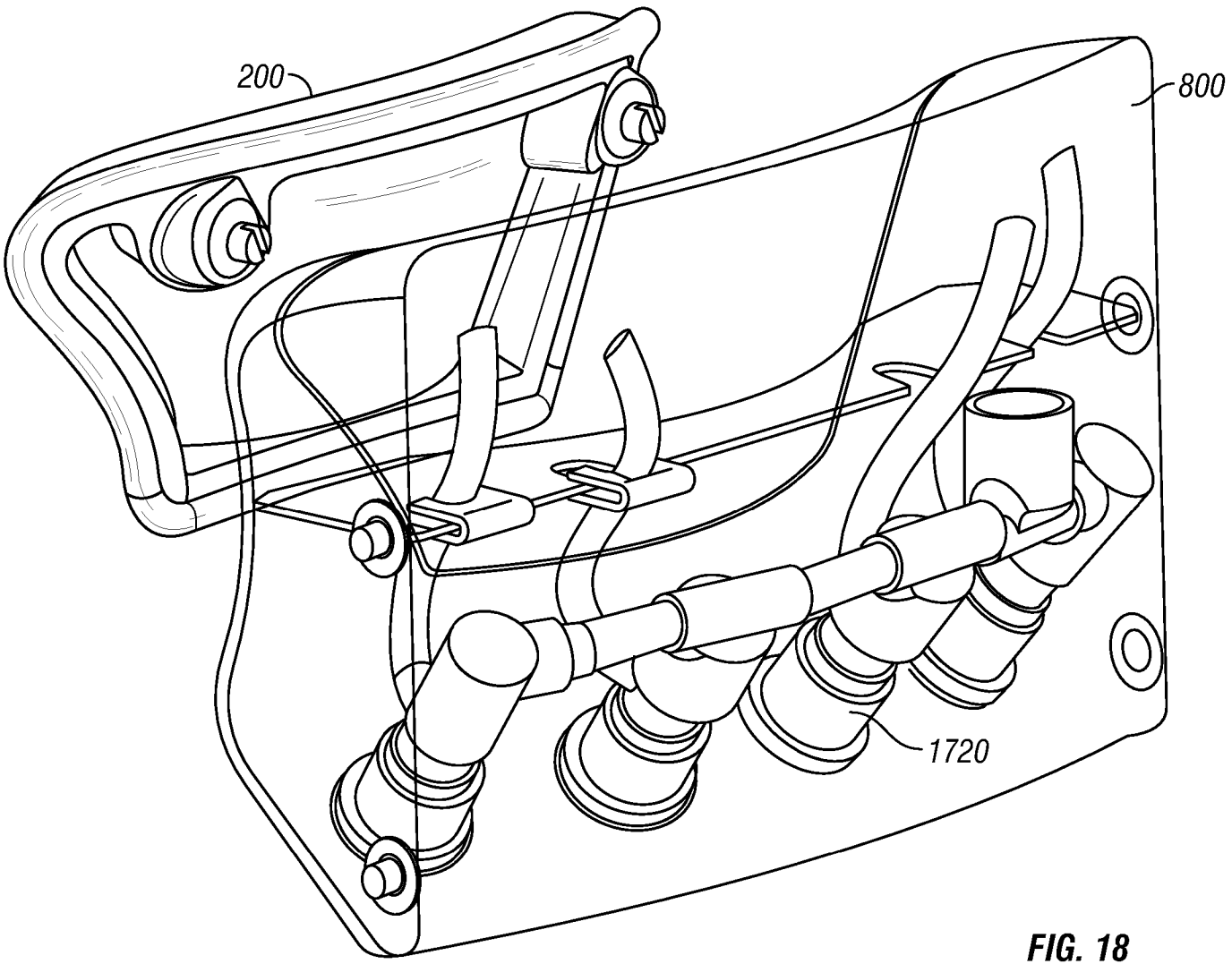
FIG. 18 is an exploded back perspective view of the housing and headrest from FIG. 16.
Figure 19:
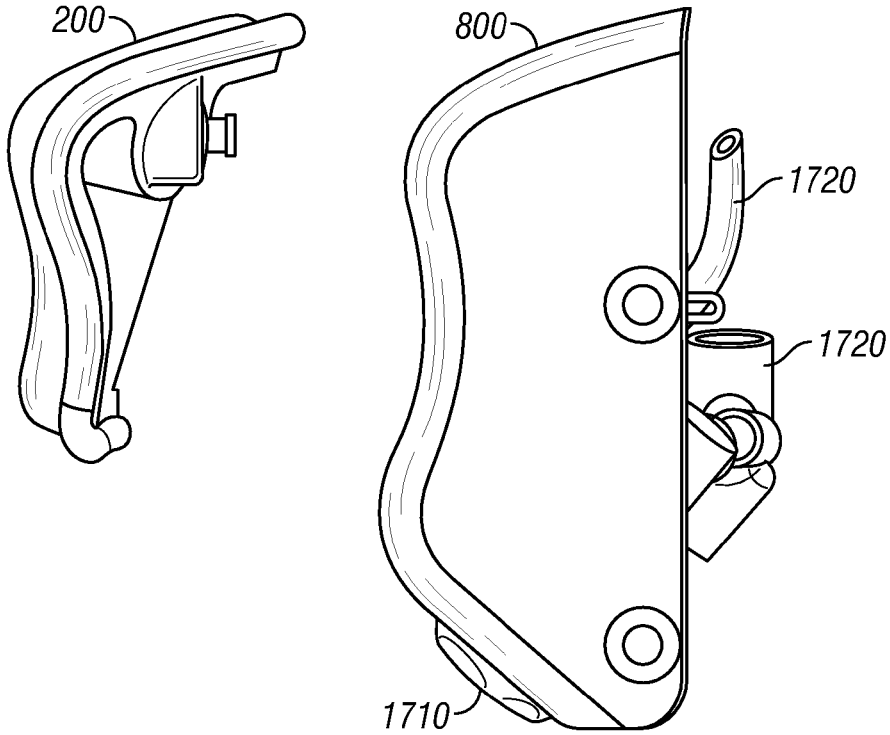
FIG. 19 is an exploded side view of the housing and headrest from FIG. 16.
Figure 20:
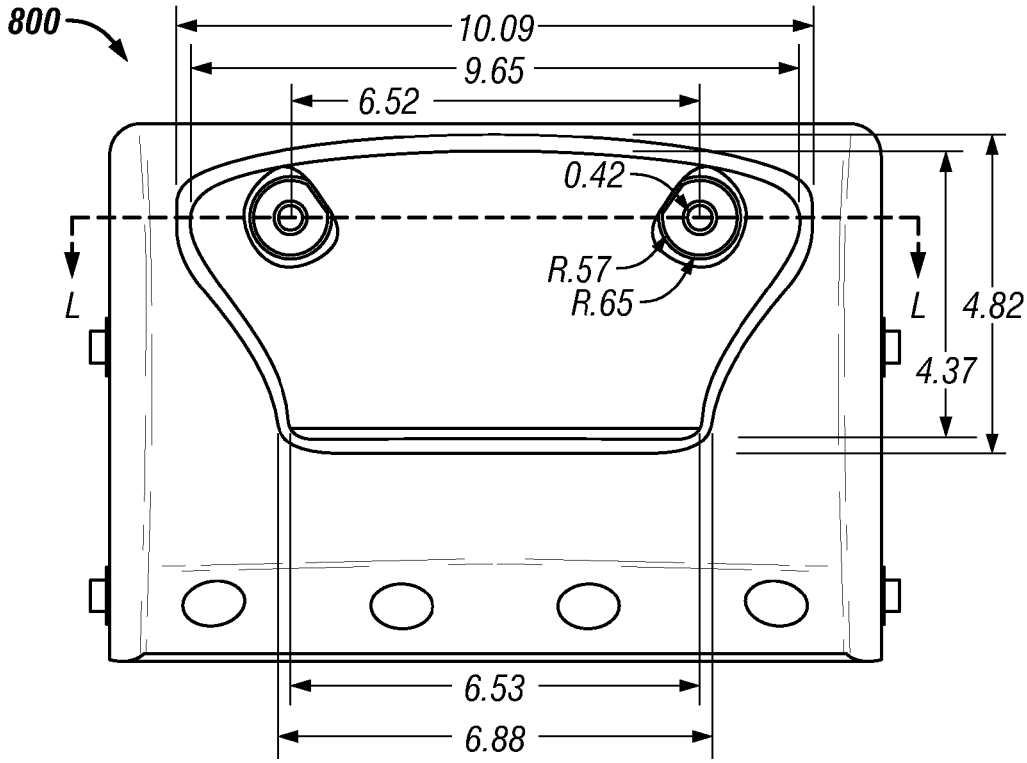
FIGS. 20-33 illustrate dimensions of the headrest pillow and housing from FIGS. 2-19.
Figure 21:
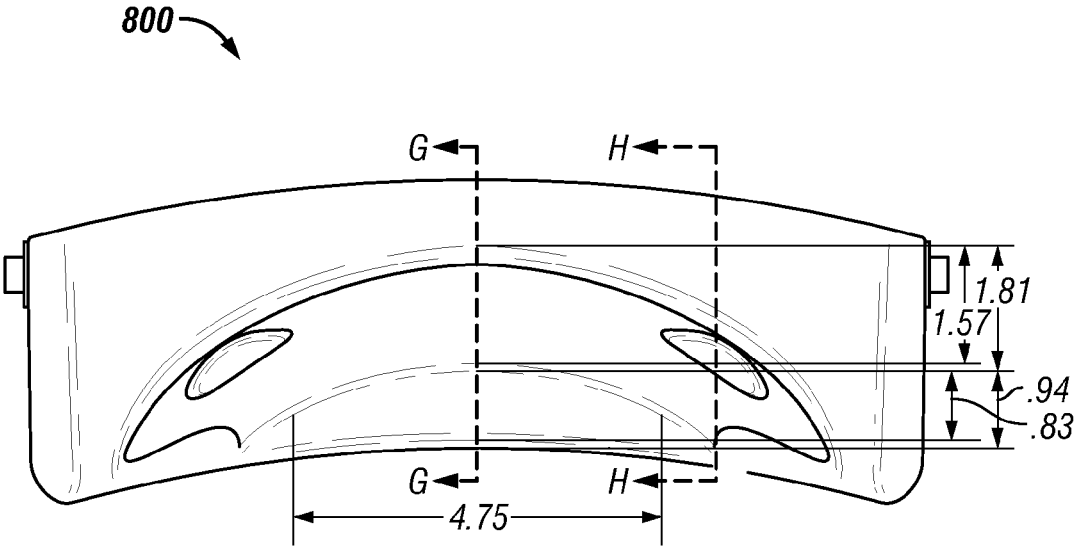
Figure 22:
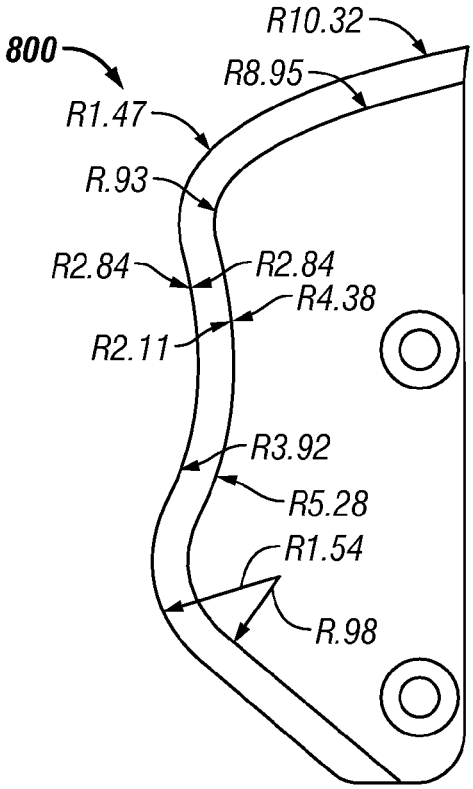
Figure 23:
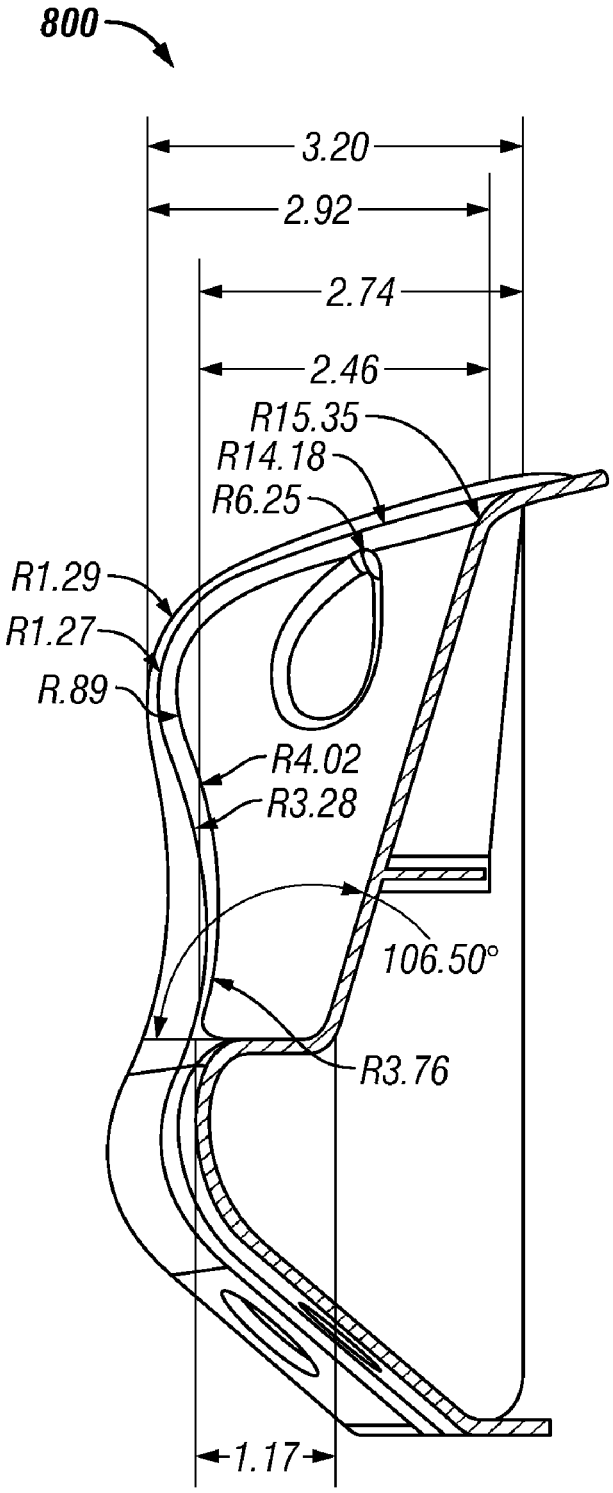
Figure 24:
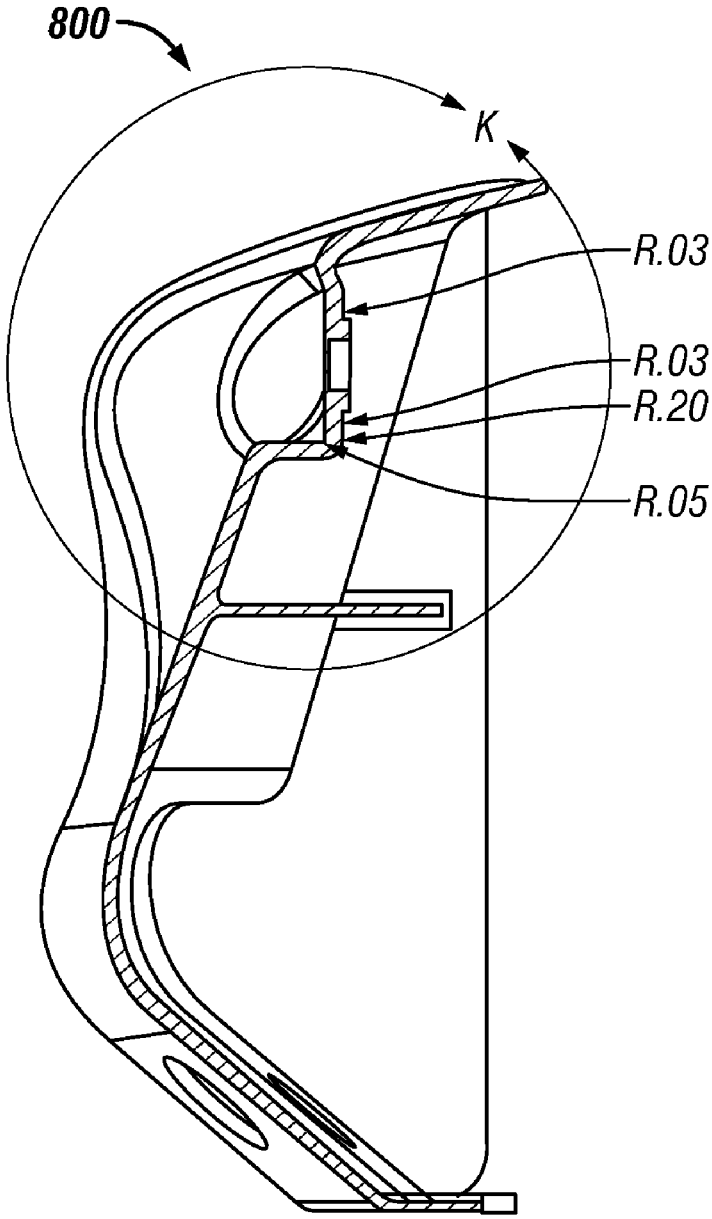
Figure 25:
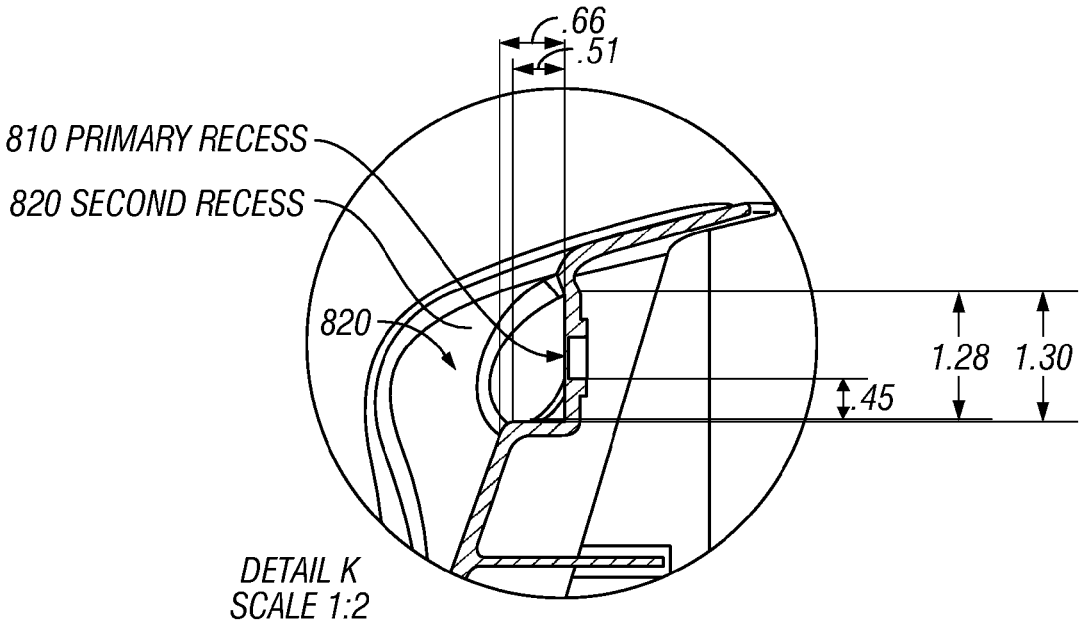
Figure 26:
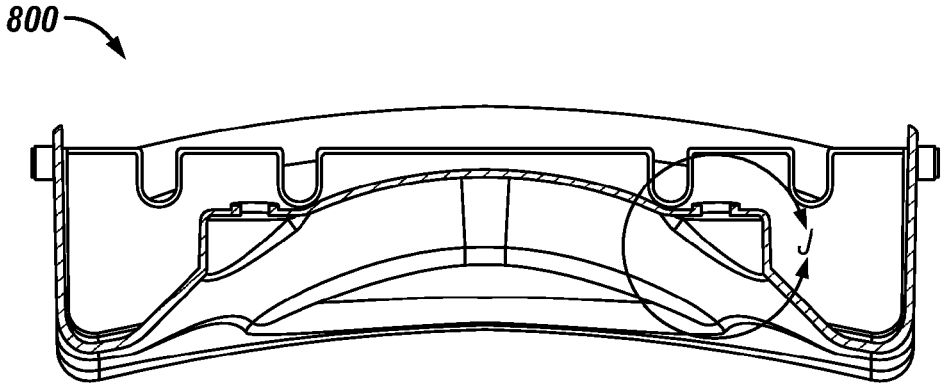
Figure 27:
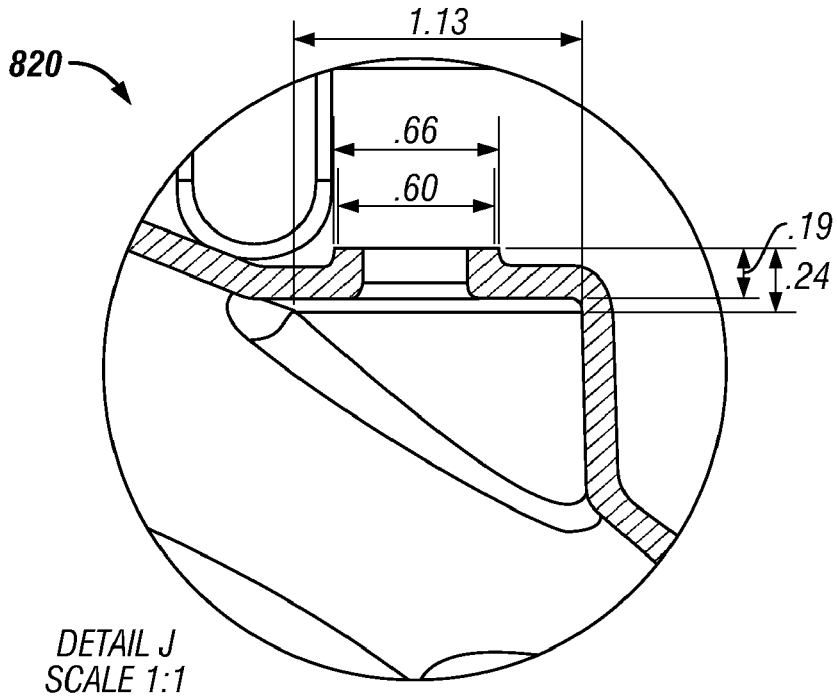
Figure 28:
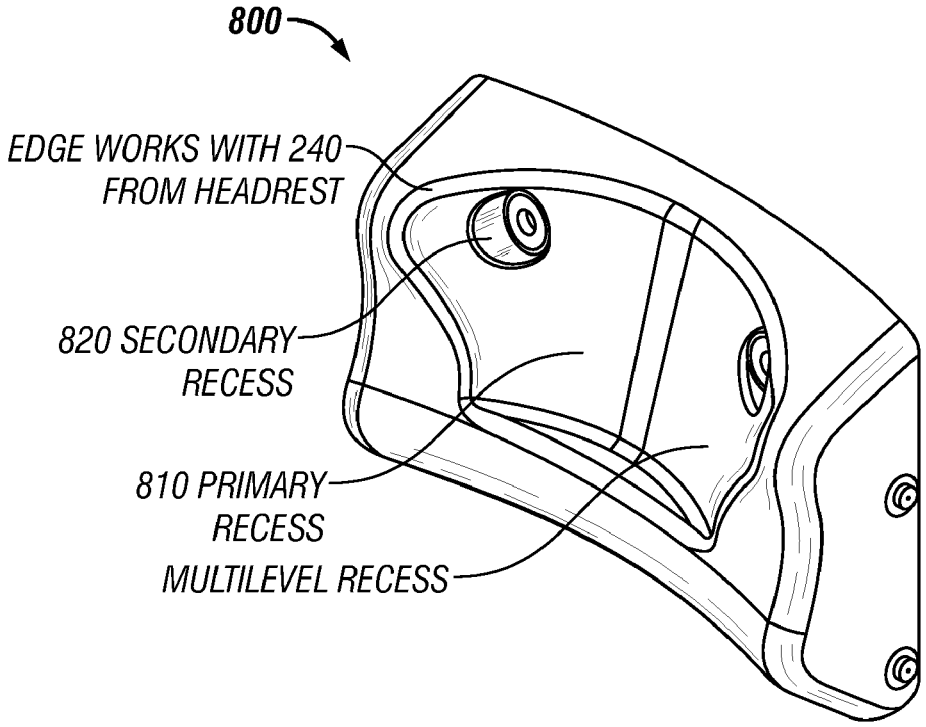
Figure 29:
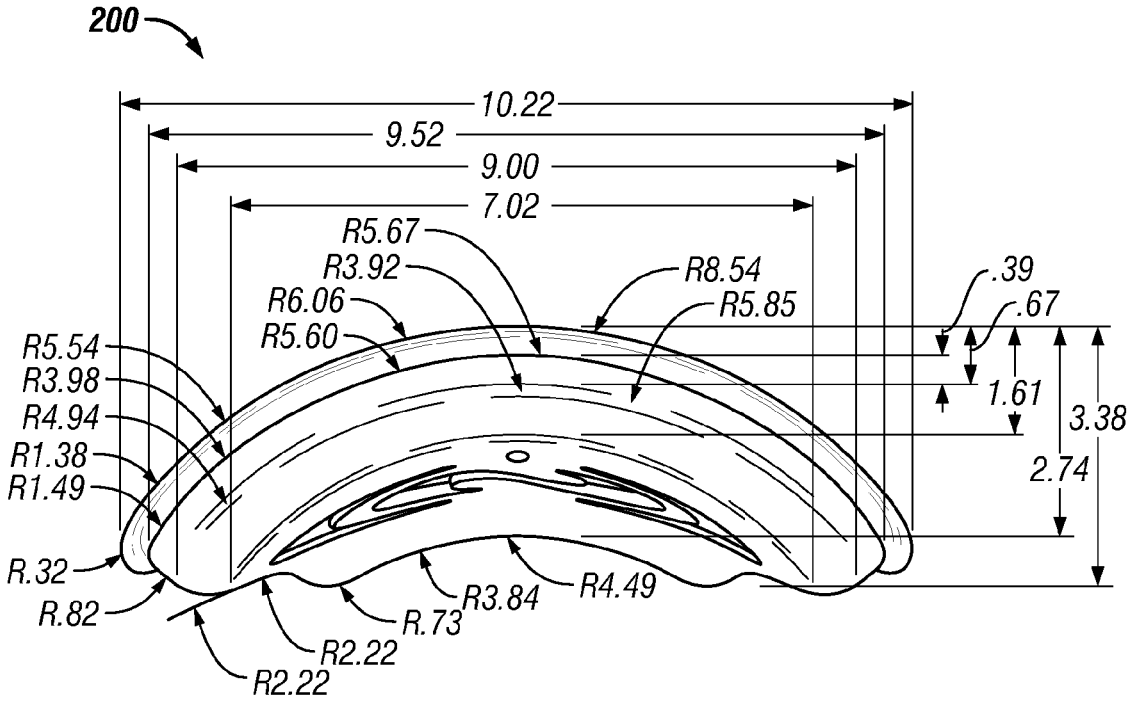
Figure 30:
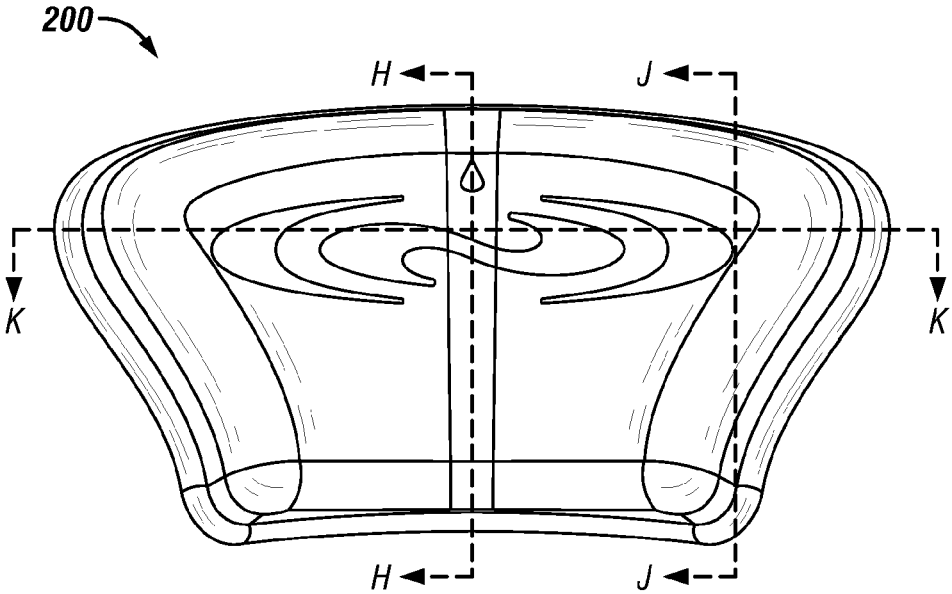
Figure 31:
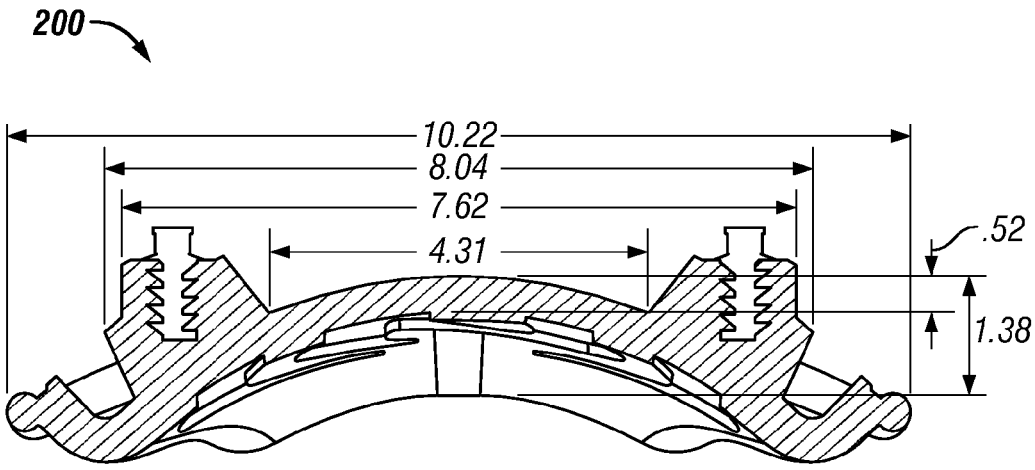
Figure 32:
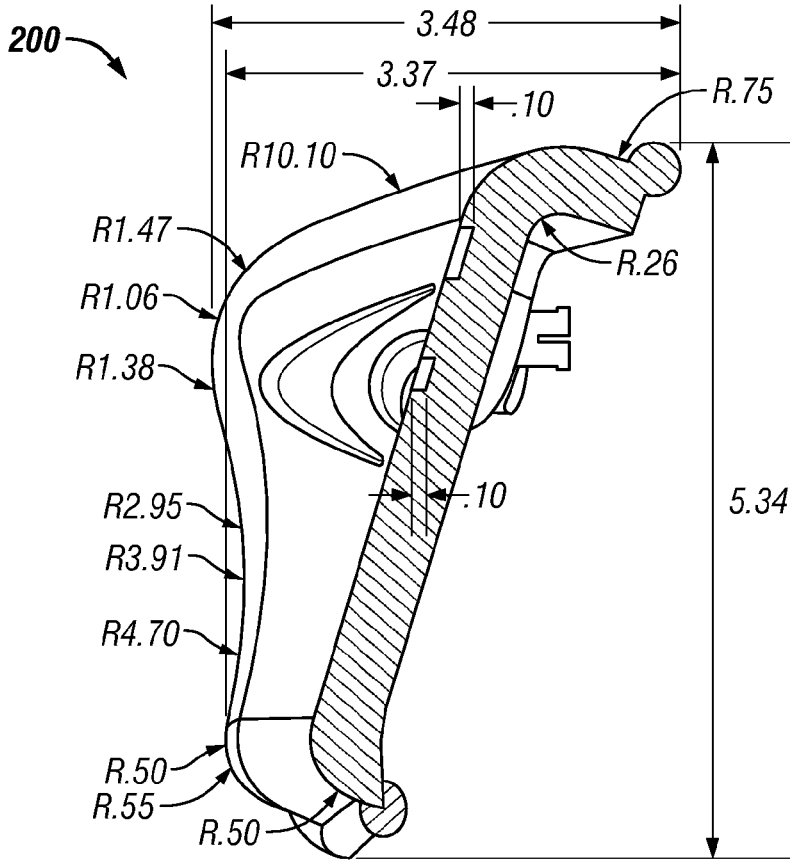
Figure 33:
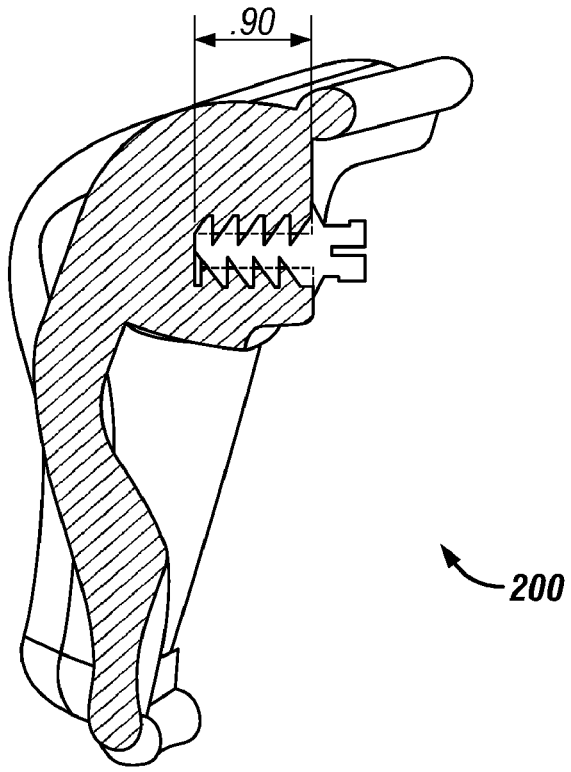

FIG. 18 is an exploded back perspective view of the housing 800 and headrest 200 with pipe(s) 1720 included in the housing 800. FIG. 19 is an exploded side view of the housing 800 and headrest 200 with pipe(s) 1720 and jet(s) 1710 included in the housing 800.

As illustrated in FIGS. 8-19, a spa surface defines a multi-level recess including a primary recess 810 and secondary mounting recesses 820. The multi-level recess design allows a mechanical flexing action to occur when used with the pillow 200. The multi-level recess design works in connection with the pillow to create a higher level of comfort for a user of the spa. The pillow 200 can be mounted in a molded plastic carrier or other spa surface, such as a spa wall or shell.

The mechanical flexing movement properties of the pillow connected with the spa surface defining the multi-level recess is created by the interaction of the pillow and the primary and secondary recesses. The pillow is mounted into the two secondary mounting recesses 820 that are inside the primary recess 810. The boss height of the pillow mounting pins allow the main body of the pillow to float above the primary recess 810. The primary recess 810 works in tandem with the main body of the pillow. The curved edges of the pillow's main body contact the primary recess 810 in such a manner that a mechanical flexing action occurs when a load or pressure is applied at or near the centerline of the pillow. The curved edges of the pillow contact the primary recess 810 through the round bearing edges 240 of the pillow. The round bearing edges 240 of the pillow can be put in full contact with the compound curved edge of the primary recess 810 by carefully calculating the height of the mounting boss and pin. When the pillow pin 220 is mounted in the secondary recess 820, the depth helps the round bearing edge 240 conform to the primary recess 810 surface. The round bearing edge 240 works with the design of the edge of the pillow 210. The stiff sidewalls of the pillow 210 and round bearing edge 240 works together with the primary recess 810 and secondary recess 820 as a system to promote the flexure of the pillow area 230. This full bearing edge contact helps set up the flexure/mechanical movement of the design, providing a unique relationship between the pillow and the multi-level recess design.

The curve of the primary recess 810 is based on ergonomics and anthropometric data (sizes and curves of user's head) to allow a large variety of users to fit the pillow. Anthropometric data from the 1 percentile to the 99 percentile was used to design the curves. Design using these extremes allows the design to support the largest number of users. The overall angle of the multi-level recess is also taken into consideration to promote correct posture and head positioning. The angle of the pillow and multi-level recess is substantially parallel (e.g., within 5 degrees) to the back angle of a seat; the goal of the angles being to promote correct alignment of the neck, shoulders, and head. By providing the correct angles for the multi-level recess, unnecessary neck tension, which might otherwise occur when the pillow/recess system is in use, can be prevented.

The pillow and multi-level recesses work in tandem to provide a very comfortable headrest. The secondary recesses 820 have a size and height that are matched to that of the mounts on the rear of the pillow. The main body of the pillow is also designed to conform to the primary recess 810 and to flex along its edges. The secondary recesses 820 inside of the primary recess 810 can be stepped as shown (i.e., stepped away from the primary recess 810), or the secondary recesses 820 can be stepped further to provide additional levels for mounting or comfort characteristics (e.g., there can be a tertiary recess stepped away from the secondary recess). The tandem design achieves a headrest/pillow that has enhanced comfort and user characteristics. This pillow system has a very soft feel and is able to maintain this characteristic throughout the product's lifespan. Even in the event of failure, the system is easily reestablished with the replacement of the pillow component. The multi-level recess component is durable and is unlikely to fail. The multi-level recess design can be used in an injection molded design as well as a thermoformed spa shell.

FIGS. 20-33 illustrate dimensions of the headrest pillow 200 and housing 800 from FIGS. 2-19. The R X.X dimensions in FIGS. 20-33 indicate the radius dimensions for the parts, and the dimensions FIGS. 20-33 are in inches and degrees.

Figure 34:
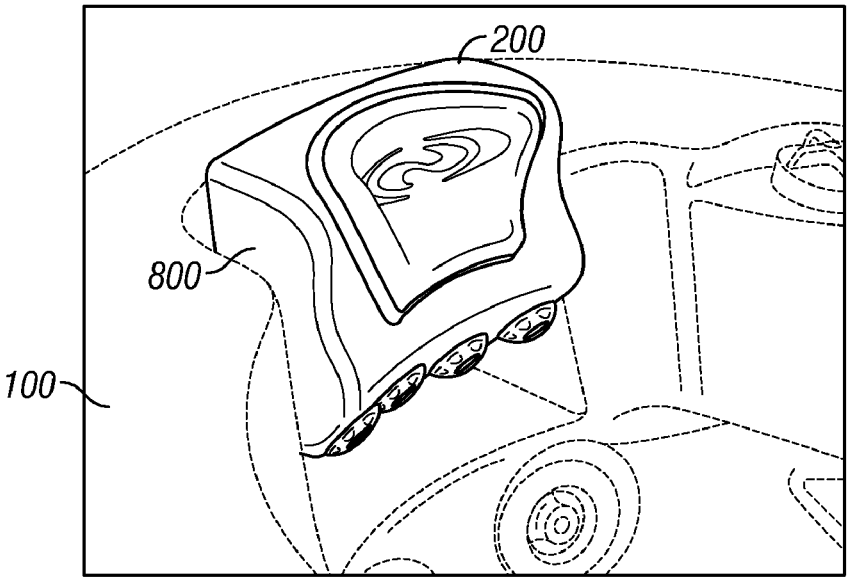
FIG. 34 is a perspective view of the headrest and housing in a spa.
Figure 35:
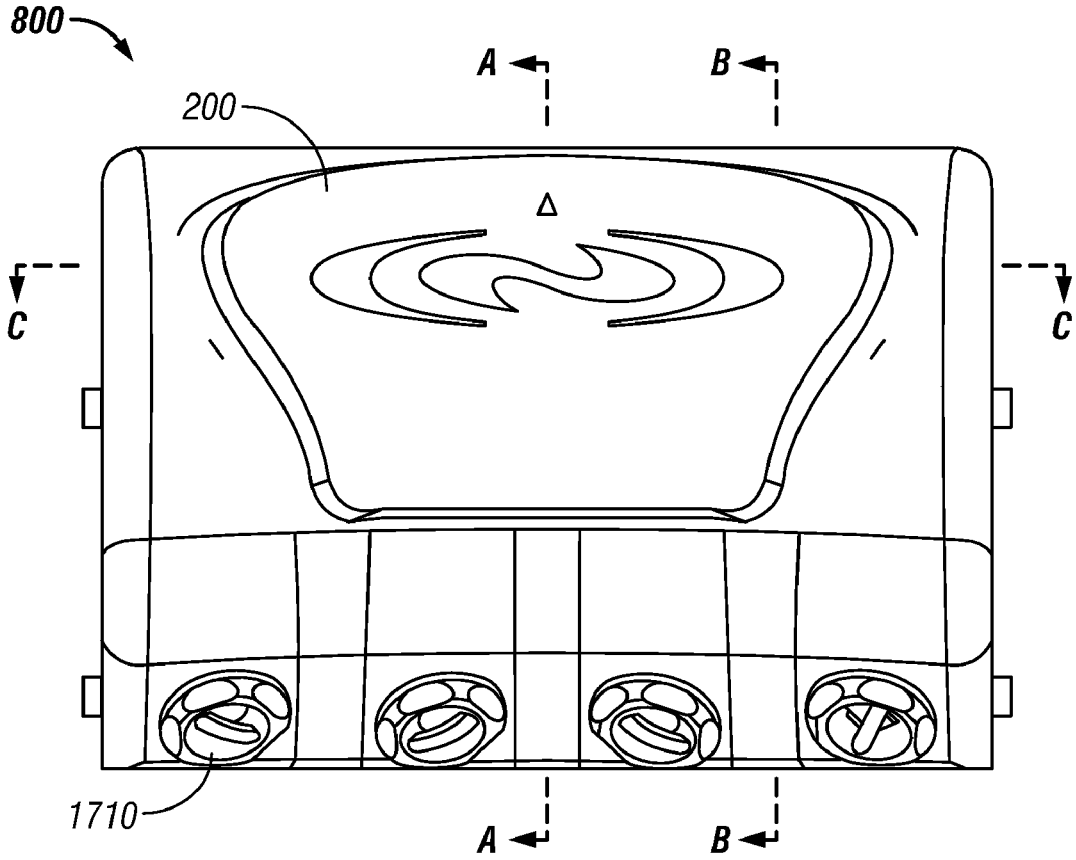
FIGS. 35-38 show a front view and three cross-section views of the housing and headrest from FIGS. 14-17.
Figure 36:
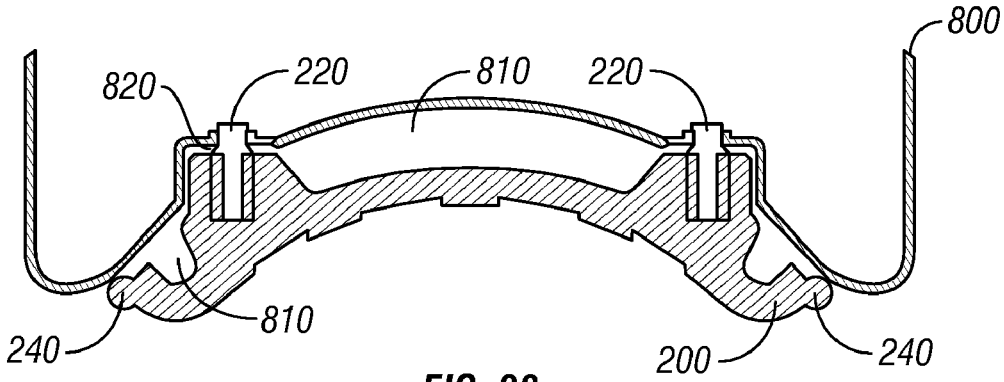
Figure 37:
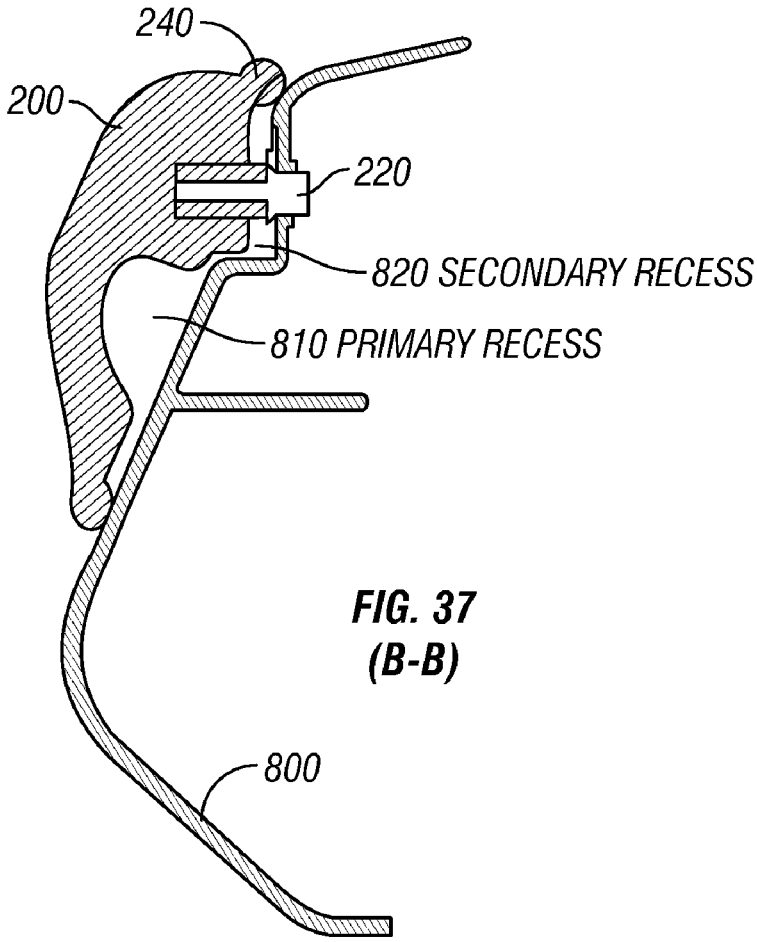
Figure 38:
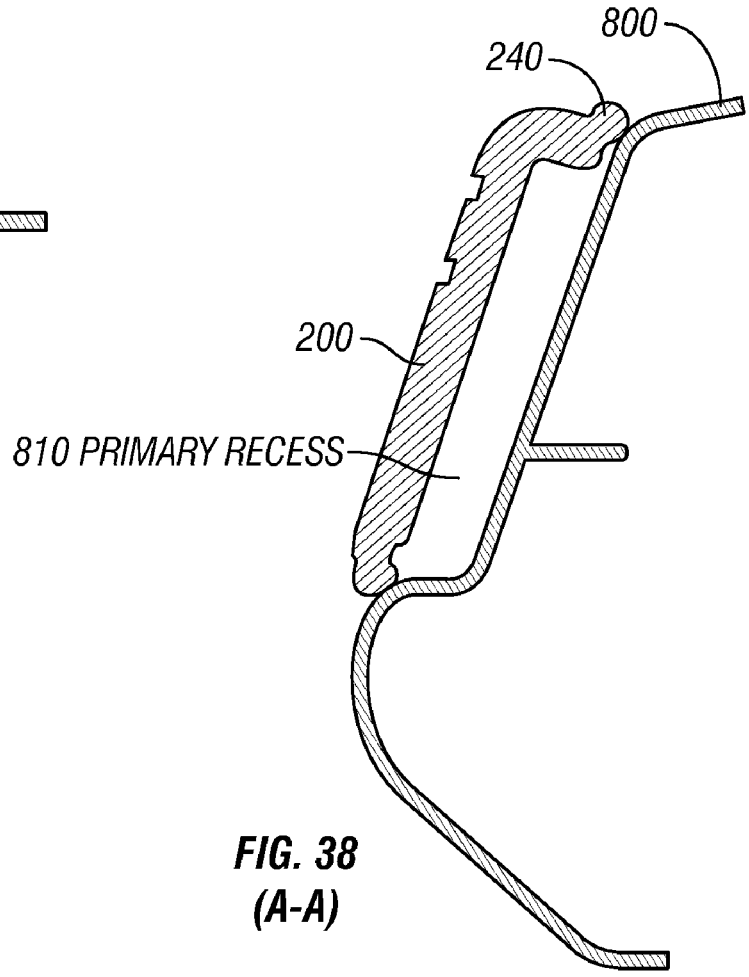

FIG. 34 is a perspective view of the headrest 200 and housing 800 in a spa 100.

Other embodiments may be within the scope of the following claims.

What is claimed is:

1. A system comprising:

a surface defining a multi-level recess including a primary recess and secondary mounting recesses; and a pillow comprising a flexible concave pad and mounts that couple the flexible concave pad with the surface, the secondary mounting recesses receiving the mounts such that the flexible concave pad is suspended above the primary recess, a curved edge of the flexible concave pad contacts the surface, and the flexible concave pad mechanically flexes concavely between the mounts and about the curved edge when force is applied at or near the center line of the pillow.

2. The system of claim 1, wherein the surface defines the primary recess having a curve that accommodates a large variety of head sizes and shapes.

3. The system of claim 1, wherein the surface defines the primary recess having an overall angle that promotes correct posture and head positioning.

4. The system of claim 1, wherein the flexible concave pad has a thin material cross section with a thickness of between 0.25 inches and 0.7 inches.

5. The system of claim 4, wherein the thickness is between 0.4 inches and 0.6 inches.

6. The system of claim 4, wherein the flexible concave pad comprises Urethane and Silicone.

7. The system of claim 4, wherein the flexible concave pad comprises Ethylene Vinyl Acetate.

8. The system of claim 1, wherein the surface defines the secondary mounting recesses as stepped recesses.

9. The system of claim 1, wherein the mounts comprise flexible pins that couple with the flexible concave pad in a cantilevered fashion, each flexible pin comprising a flange and a boss, wherein the flange has a beveled side facing one of the secondary mounting recesses.

10. The system of claim 9, wherein each flexible pin further comprises a surface defining a thread on a proximate end of the pin and a surface defining a slot on a distal end of the pin.

11. The system of claim 1, further comprising a free-standing spa, wherein the surface comprises at least a portion of a spa shell of the free-standing spa.

12. The system of claim 1, further comprising a spa and a housing that couples with a spa wall of the spa, wherein the surface comprises at least a portion of the housing.

13. The system of claim 12, wherein the housing includes jets and pipes that feed the jets.

14. A spa comprising the system of claim 1 and further comprising a spa wall.

15. The spa of claim 14, wherein the surface defines the primary recess having dimensions that accommodate a large variety of head sizes and shapes and that promote correct posture and head positioning.

16. The spa of claim 15, wherein the mounts comprise flexible pins, including means for screwing the flexible pins into the flexible pad, and the flexible pad has a thin material cross section with a thickness of between 0.25 inches and 0.7 inches.

17. The spa of claim 16, further comprising a housing that couples with the spa wall.

* * * * *